US010519817B1

(12) United States Patent
Mariuz et al.

(10) Patent No.: US 10,519,817 B1
(45) Date of Patent: Dec. 31, 2019

(54) SWITCHABLE ROCKER ARM WITH LASH ADJUSTMENT AND TRAVEL STOP

(71) Applicant: DELPHI TECHNOLOGIES IP LIMITED, St. Michael (BB)

(72) Inventors: Robert M. Mariuz, Pittsford, NY (US); Chad E. Uckermark, Warwick, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/116,247

(22) Filed: Aug. 29, 2018

(51) Int. Cl.

| | |
|---|---|
| ***F01L 1/18*** | (2006.01) |
| ***F01L 13/00*** | (2006.01) |
| *F01L 1/46* | (2006.01) |
| *F01L 1/24* | (2006.01) |

(52) U.S. Cl.
CPC ..... *F01L 1/181* (2013.01); *F01L 13/0005* (2013.01); *F01L 13/0021* (2013.01); *F01L 1/24* (2013.01); *F01L 2001/186* (2013.01); *F01L 2001/467* (2013.01)

(58) Field of Classification Search
CPC ..... F01L 2001/186; F01L 1/20; F01L 1/46; F01L 13/0005; F01L 2103/00; F01L 2105/00
USPC ..... 123/90.41, 90.42, 90.44, 90.45
See application file for complete search history.

(56) References Cited

U.S. PATENT DOCUMENTS

| | | | | |
|---|---|---|---|---|
| 4,151,817 | A * | 5/1979 | Mueller | F01L 1/185 123/198 F |
| 5,655,488 | A * | 8/1997 | Hampton | F01L 1/185 123/90.16 |
| 6,668,779 | B2 | 12/2003 | Hendriksma et al. | |
| 7,305,951 | B2 | 12/2007 | Fernandez et al. | |
| 7,308,872 | B2 | 12/2007 | Sellnau et al. | |
| 7,798,113 | B2 * | 9/2010 | Fischer | F01L 1/185 123/90.39 |
| 7,882,814 | B2 | 2/2011 | Spath et al. | |
| 7,963,260 | B2 * | 6/2011 | Kreuter | F01L 13/0036 123/90.16 |
| 8,733,311 | B2 * | 5/2014 | Manther | F01L 1/185 123/90.16 |
| 9,765,658 | B2 | 9/2017 | Knauf et al. | |
| 2003/0209217 | A1 * | 11/2003 | Hendriksma | F01L 1/182 123/90.44 |
| 2004/0177820 | A1 * | 9/2004 | Kreuter | F01L 1/181 123/90.16 |
| 2008/0283003 | A1 * | 11/2008 | Hendriksma | F01L 1/18 123/90.6 |

(Continued)

*Primary Examiner* — Jorge L Leon, Jr.
(74) *Attorney, Agent, or Firm* — Joshua M. Haines

(57) ABSTRACT

A rocker arm includes an outer arm and an inner arm which selectively pivot relative to each other. A lock pin moves between a coupled position in which the lock pin prevents the inner arm from pivoting relative to the outer arm past a predetermined in a first direction and a decoupled position in which the lock pin permits rotation past the predetermined position in the first direction. A lost motion spring biases the inner arm to pivot relative to the outer arm in a second direction which is opposite of the first direction. A travel stop extends along a travel stop axis and has a travel stop surface such that the extent to which the inner arm pivots relative to the outer arm in the second direction is dependent upon the rotational position of the travel stop about the travel stop axis.

17 Claims, 9 Drawing Sheets

(56) References Cited

U.S. PATENT DOCUMENTS

| | | | | |
|---|---|---|---|---|
| 2009/0126527 | A1* | 5/2009 | Bauman | F01L 1/18 74/569 |
| 2013/0312689 | A1* | 11/2013 | Zurface | F01L 13/0036 123/90.45 |
| 2017/0284313 | A1* | 10/2017 | Shewell | F02D 13/0211 |
| 2018/0045081 | A1 | 2/2018 | Rehm et al. | |

* cited by examiner

SWITCHABLE ROCKER ARM WITH LASH ADJUSTMENT AND TRAVEL STOP

TECHNICAL FIELD OF INVENTION

The present invention relates to a rocker arm for valve train of an internal combustion engine; more particularly to a rocker arm with an inner arm and an outer arm which pivot relative to each other, and even more particularly to such a rocker arm with a travel stop which sets lash between the inner arm and a lock pin and which also limits travel of the inner arm relative to the outer arm.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second and lesser valve lift mode, that is greater than no lift. It should be noted that the second valve lift mode may provide one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm where the inner arm includes an inner arm follower which follows a first profile of a camshaft of the internal combustion engine and where the outer arm may include a pair of outer arm followers which follow respective second and third profiles of the camshaft. The follower of the inner arm and the followers of the outer arm may be either sliding surfaces or rollers and combinations thereof. The inner arm is movably connected to the outer arm and can be switched from a coupled state wherein the inner arm is immobilized relative to the outer arm, to a decoupled state wherein the inner arm can move relative to the outer arm. Typically, the outer arm of the switchable rocker arm is pivotally supported at a first end by the hydraulic lash adjuster which fits into a socket of the outer arm. A second end of the outer arm operates against an associated engine valve for opening and closing the valve by the rotation of an associated eccentric cam lobe acting on the follower of the inner arm. The inner arm is connected to the outer arm for pivotal movement about the outer arm's second end with the follower of the inner arm disposed between the first and second ends of the outer arm. Switching between the coupled state and the decoupled state is accomplished through a lock pin which is slidingly positioned in a lock pin bore of the outer arm. One end of the lock pin is moved into and out of engagement with the inner arm. Consequently, when the lock pin is engaged with the inner arm, the coupled state is achieved. Conversely, when the lock pin is not engaged with the inner arm, the decoupled state is achieved. As shown in U.S. Pat. No. 7,305,951 to Fernandez et al., the disclosure of which is hereby incorporated by reference in its entirety, the other end of the lock pin acts as a piston upon which pressurized oil is applied and vented to affect the position of the lock pin. Also as shown by Fernandez et al., oil is supplied to the lock pin via an oil supply bore which originates in the socket and breaks into the lock pin bore.

Variations in manufacturing of the various components of the switchable rocker arm lead to varying magnitudes of lash between the lock pin and the inner arm where the lash is the distance between the lock pin and the surface of the inner arm which engages the lock pin when the inner follower or the outer followers are engaged with the base circle of the camshaft. Negative lash, i.e. interference, prevents the lock pin from moving from the decoupled state to the coupled state while excessive lash affects the valve lift when the lock pin is in the coupled state. In order to provide a desired magnitude of lash, it is known to use a manufacturing process which provides a plurality of inner followers, typically in the form of a roller, of various known sizes, where this process is typically called zoning. During manufacturing, the lash is observed. If the lash falls outside of the desired tolerance range, a different inner follower is selected from the plurality of different sizes and the original inner follower is replaced in order to bring the lash into the desired tolerance range. Alternatively, it is also known to use this same process, except with the outer followers, to bring the lash into the desired tolerance range. While this process may be effective, it adds complexity and time to the manufacturing process and also increases costs since the inner followers must be zoned. In another alternative, zoned lock pins may also be used to bring the lash into the desired tolerance range. However, just as with zoning the followers, zoning the lock pins adds complexity and time to the manufacturing process and also increases costs.

Additionally, it is desirable to limit the extent to which the inner arm is able to rotate relative to the outer arm in a direction of bias provided by a lost motion spring which keeps the inner arm in contact with the camshaft when switchable rocker arm is in the decoupled state. Limiting the extent to which the inner arm is able to rotate relative to the outer arm in this direction is important, particularly prior to the switchable rocker arm being installed in the engine, because if the inner arm is left unconstrained, the switchable rocker arm may be susceptible to unintended disassembly. Limiting the extent to which the inner arm is able to rotate relative to the outer arm in this direction is also important in some switchable rocker arm designs because without limiting rotation, the lost motion spring of the rocker arm may place a load on the camshaft and lash adjuster which would prevent the lash adjuster from expanding as intended after a lift event has occurred.

What is needed is a rocker arm which minimizes or eliminates one or more of the shortcomings as set forth above.

SUMMARY OF THE INVENTION

Briefly described, a rocker arm is provided for transmitting rotational motion from a camshaft to opening and closing motion of a combustion valve in an internal combustion engine. The rocker arm includes an outer arm and an inner arm which selectively pivot relative to each other, the inner arm having an inner follower configured to follow the camshaft; a lock pin which moves between 1) a coupled position in which the lock pin prevents the inner arm from pivoting relative to the outer arm past a predetermined position of the inner arm relative to the outer arm in a first direction and 2) a decoupled position in which the lock pin permits the inner arm to pivot relative to the outer arm past the predetermined position in the first direction; a lost motion spring which biases the inner arm to pivot relative to the outer arm in a second direction which is opposite of the first direction; and a travel stop extending along a travel stop axis and having a travel stop surface which surrounds the travel stop axis, wherein the extent to which the inner arm pivots relative to the outer arm in the second direction is dependent upon the rotational position of the travel stop about the travel stop axis.

A method for manufacturing the aforementioned rocker arm includes rotating the travel stop about the travel stop axis to alter lash between the lock pin and the inner arm.

The rocker arm described herein allows the lash between the lock pin and the inner arm to be easily and economically set and also limits the extent to which the inner arm is able to pivot relative to the outer arm as will be more readily apparent from a thorough reading of the following description.

BRIEF DESCRIPTION OF DRAWINGS

This invention will be further described with reference to the accompanying drawings in which.

DETAILED DESCRIPTION OF INVENTION

Figure 1:
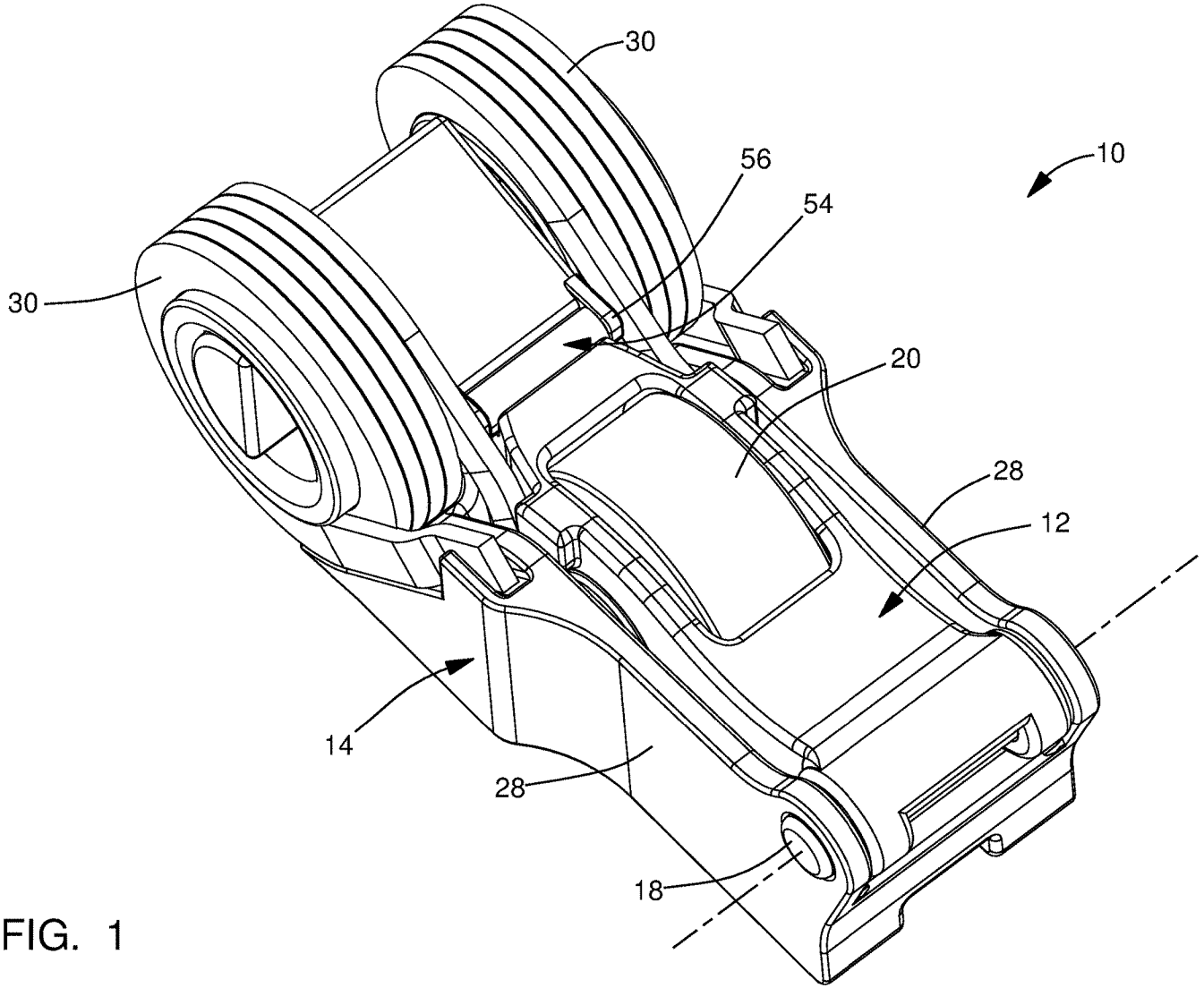
FIG. 1 is an isometric view of a rocker arm in accordance with the present invention.
Figure 2:
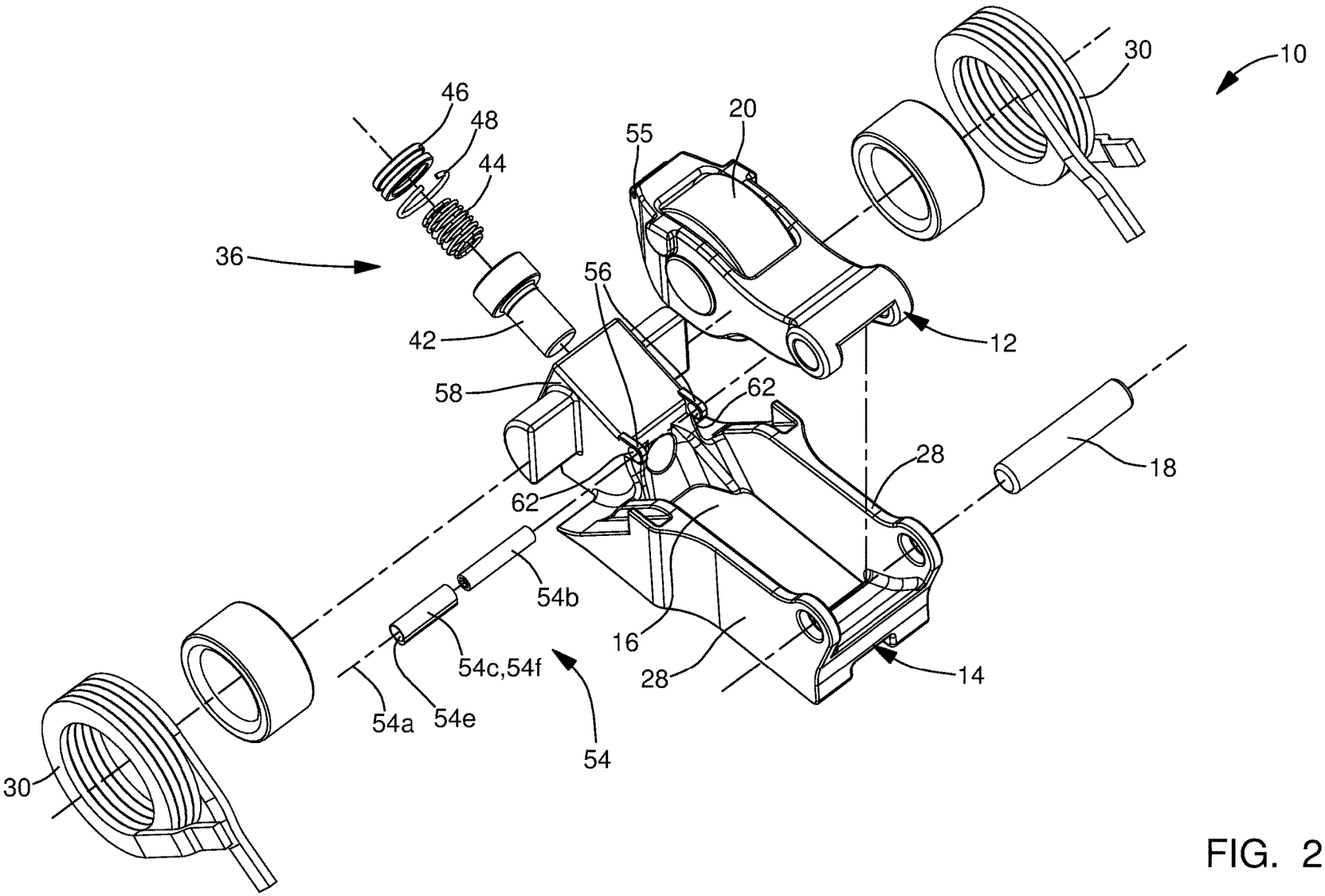
FIG. 2 is an exploded isometric view of the rocker arm of FIG. 1.

Referring to the figures, a rocker arm 10 in accordance with the invention is illustrated where rocker arm 10 is presented for illustrative purposes as a deactivation rocker arm but may alternatively be a two-step rocker arm, both of which may generically be referred to as a switchable rocker arm. Rocker arm 10 is included in valve train (not shown) of an internal combustion engine (not shown) in order to translate rotational motion of a camshaft 11 about camshaft axis 11*a* to reciprocating motion of a combustion valve (not shown). As is known in the art of combustion valve actuation, camshaft 11 includes a base circle 11*b* which is centered about camshaft axis 11*a* and a lifting portion 11*c* which is eccentric to camshaft axis 11*a*. In this way, base circle 11*b* does not induce movement on the combustion valve while lifting portion 11*c* opens and closes the combustion valve. Rocker arm 10 includes an inner arm 12 that is pivotably disposed in a central opening 16 in an outer arm 14. Inner arm 12 and outer arm 14 selectively pivot relative to each other about a pivot shaft 18. Inner arm 12 includes a follower illustrated as a roller 20 carried by a roller shaft 22 that is supported by inner arm 12 such that roller 20 and roller shaft 22 are centered about a roller shaft axis 24. Roller 20 is configured to follow base circle 11*b* and lifting portion 11*c*, to selectively impart lifting motion on a respective combustion valve. A bearing 26 may rotatably support roller 20 on roller shaft 22 for following base circle 11*b* and lifting portion 11*c* of camshaft 11. Bearing 26 may be, for example, a plurality of rollers or needle bearings. Roller shaft 22 is fixed to inner arm 12, by way of non-limiting example only, by staking each end of roller shaft 22 in order to cause each end of roller shaft 22 to be increased in diameter to prevent removal from inner arm 12. Outer arm 14 includes two walls 28 positioned parallel to each other such that walls 28 are perpendicular to roller shaft axis 24 and such that walls 28 are spaced apart from each other to define central opening 16 therebetween. A pair of lost motion springs 30 acts between inner arm 12 and outer arm 14 to pivot inner arm 12 away from outer arm 14. Lost motions springs 30 have been illustrated herein, by way of non-limiting example only, as coil torsion springs which each include a first leg grounded to inner arm 12 and a second leg grounded to outer arm 14, however, it should be understood that other lost motion spring types, i.e. coil compression springs, and their locations are anticipated as are known in the art of switchable rocker arms. A socket 32 for pivotably mounting rocker arm 10 on a lash adjuster (not shown) is included at a first end 14*a* of outer arm 14 while a pad 34 for actuating a valve stem (not shown) is proximal to a second end 14*b* of outer arm 14. A latching arrangement 36 disposed within outer arm 14 at first end 14*a* thereof selectively permits inner arm 12 to pivot relative to outer arm 14 about pivot shaft 18 and also selectively prevents inner arm 12 from pivoting relative to outer arm 14 about pivot shaft 18. While the follower of inner arm 12 has been illustrated as roller 20, it should be understood that the follower of inner arm 12 may alternatively be a sliding surface as shown in U.S. Pat. No. 7,305,951 to Fernandez et al. Additionally, while outer arm 14 has been illustrated herein as not including followers which follow respective profiles of camshaft 11, it should be understood that outer arm 14 may include followers such as rollers as shown in U.S. Pat. No. 7,305,951 or such as sliding surfaces as shown in U.S. Pat. No. 7,882,814 to Spath et al. and U.S. Pat. No. 6,668,779 to Hendriksma et al., the disclosures of which are hereby incorporated by reference in their entirety. When included, the followers of the outer arms are utilized to follow a profile of camshaft 11 which is a circle in the case of rocker arm 10 being a deactivation rocker arm and the followers of the outer arm are utilized to follow a profile of camshaft 11 which includes an eccentric portion similar to lifting portion 11*c* which provides a different magnitude of lifting motion to rocker arm 10 in the case of rocker arm 10 being a two-step rocker arm.

Figure 3:
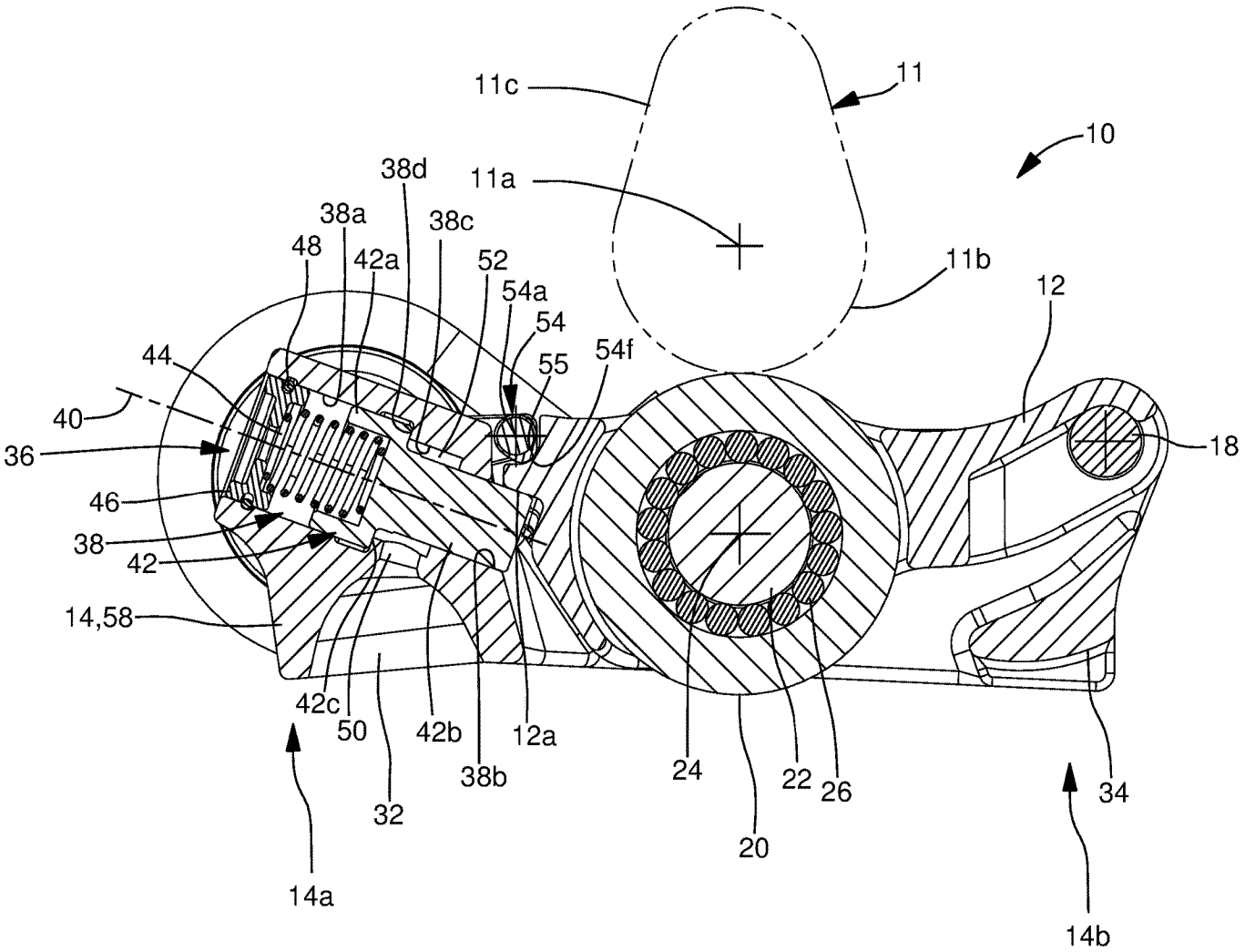
FIG. 3 is a cross-sectional view of the rocker arm of FIG. 1, taken through a plane that is perpendicular to an axis of rotation of a central follower of the rocker arm, showing a latching arrangement of the rocker arm in a coupled state.
Figure 4:
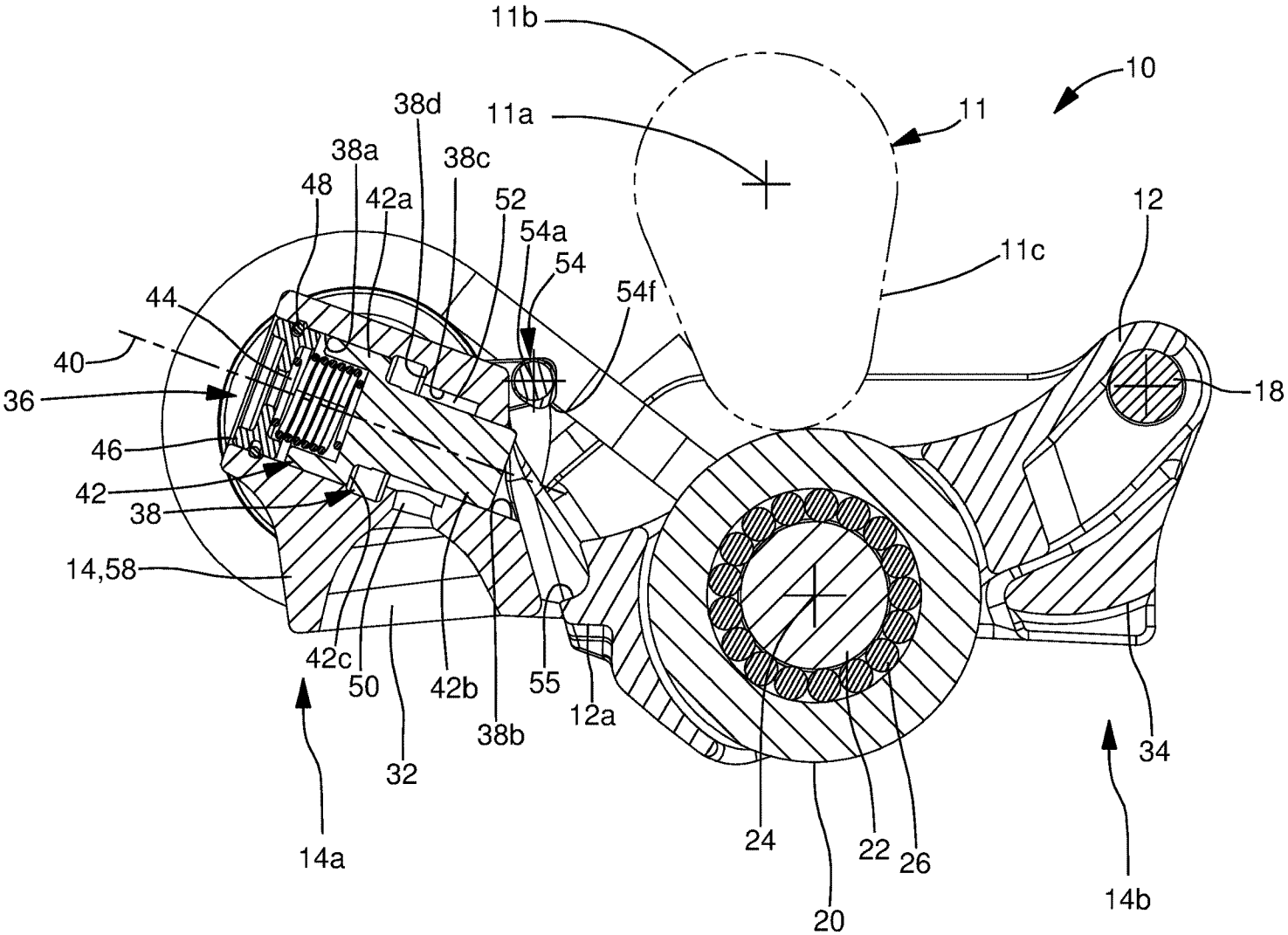
FIG. 4 is the cross-sectional view of FIG. 3, now showing the latching arrangement in a decoupled state.

Rocker arm 10 is selectively switched between a coupled state and a decoupled state by latching arrangement 36 which is actuated by application and venting of pressurized oil as will be described in greater detail later. In the coupled state as shown in FIG. 3, inner arm 12 is prevented from pivoting relative to outer arm 14 past a predetermined position of inner arm 12 relative to outer arm 14 in a first direction, shown as counterclockwise in FIG. 3. In this way, in the coupled state, inner arm 12, and therefore roller shaft 22, is coupled to outer arm 14, and rotation of lifting portion 11*c* is transferred from roller 20 through roller shaft 22 to pivotal movement of outer arm 14 about the lash adjuster which, in turn, reciprocates the associated valve. In the decoupled state as shown in FIG. 4, inner arm 12 is able to pivot relative to outer arm 14 past the predetermined position in the first direction. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12, together with roller 20 and roller shaft 22, reciprocate within central opening 16, thereby compressing and uncompressing lost motion springs 30 in a cyclic manner such that lost motion springs 30 bias inner arm 12 to pivot relative to outer arm 14 in a second direction, shown as clockwise in FIG. 4, which is opposite from the first direction.

Latching arrangement 36 will now be described in greater detail. Latching arrangement 36 includes a lock pin bore 38 which is centered about, and extends along, a lock pin bore axis 40 into outer arm 14. Latching arrangement 36 also includes a lock pin 42 which is slidably disposed in lock pin bore 38. Lock pin 42 selectively engages inner arm 12 as shown in FIG. 3, thereby preventing inner arm 12 from pivoting relative to outer arm 14 in the first direction past the predetermined position. Lock pin 42 also selectively disengages inner arm 12 as shown in FIG. 4, thereby allowing inner arm 12 to pivot relative to outer arm 14 in the first direction past the predetermined position. Latching arrangement 36 also includes a lock pin spring 44 which urges lock pin 42 into engagement with inner arm 12 when desired. Lock pin spring 44 is grounded to outer arm 14 by a lock pin stop 46 which is fixed within lock pin bore 38, for example only, by interference fit and/or a retaining ring 48 engaging complementary annular grooves in the outer periphery of lock pin stop 46 and in the inner periphery of lock pine bore 38 as shown. Lock pin spring 44 is captured axially between lock pin stop 46 and lock pin 42. Conversely, pressurized oil is supplied to lock pin 42 through a rocker arm oil passage 50 which extends from socket 32 to lock pin bore 38, thereby compressing lock pin spring 44 and disengaging lock pin 42 from inner arm 12 when desired. The supply of pressurized oil to lock pin 42 may be controlled, for example, by an oil control valve (not shown) which receives oil from an oil supply (not shown) of the internal combustion engine.

Lock pin bore 38 includes three distinct sections, namely a lock pin bore first section 38*a* that is distal from inner arm 12, a lock pin bore second section 38*b* that is proximal to inner arm 12, and a lock pin bore third section 38*c* that is coaxial with, and axially between, lock pin bore first section 38*a* and lock pin bore second section 38*b*. Lock pin bore first section 38*a* is larger in diameter than lock pin bore third section 38*c*, thereby defining a lock pin bore shoulder 38*d* where lock pin bore first section 38*a* meets lock pin bore third section 38*c* such that lock pin bore shoulder 38*d* limits the extent to which lock pin 42 is able to travel toward inner arm 12. As shown, lock pin bore first section 38*a* may itself comprise multiple discrete diameters. Lock pin bore second section 38*b* is smaller in diameter than both lock pin bore first section 38*a* and lock pin bore third section 38*c*.

Lock pin 42 is defined by two distinct sections, namely a lock pin piston section 42*a* which is disposed within lock pin bore first section 38*a* and a lock pin locking section 42*b* which is disposed within lock pin bore second section 38*b* and lock pin bore third section 38*c* under all operating conditions and is also disposed within lock pin bore first section 38*a* when lock pin 42 is not engaged with inner arm 12. Lock pin piston section 42*a* is sized to fit within lock pin bore first section 38*a* in a close sliding fit such that oil is substantially prevented from passing between the interface of lock pin piston section 42*a* and lock pin bore first section 38*a*, radial movement of lock pin piston section 42*a* within lock pin bore first section 38*a* is substantially prevented, and lock pin piston section 42*a* is allowed to move along lock pin bore axis 40 within lock pin bore first section 38*a* substantially uninhibited. Lock pin locking section 42*b* is sized to fit within lock pin bore second section 38*b* in a close sliding fit such that oil is substantially prevented from passing between the interface of lock pin locking section 42*b* and lock pin bore second section 38*b*, radial movement of lock pin locking section 42*b* is substantially prevented, and lock pin locking section 42*b* is allowed to move along lock pin bore axis 40 within lock pin bore second section 38*b* substantially uninhibited. Consequently, a lock pin shoulder 42*c* is defined between lock pin piston section 42*a* and lock pin locking section 42*b*, thereby providing a surface for oil to act upon and also providing a surface to abut lock pin bore shoulder 38*d* to limit travel of lock pin 42 toward inner arm 12. Conversely, the travel of lock pin 42 away from inner arm 12 is limited by lock pin stop 46. Since lock pin bore third section 38*c* is larger in diameter than lock pin bore second section 38*b*, an annular pressure chamber 52 is defined radially between lock pin locking section 42*b* and lock pin bore third section 38*c*. Rocker arm oil passage 50 enters lock pin bore 38 at lock pin bore third section 38*c* such that rocker arm oil passage 50 is located entirely between lock pin bore first section 38*a* and lock pin bore second section 38*b* in order for the oil to be supplied to pressure chamber 52 and have access to lock pin shoulder 42*c*.

While latching arrangement 36 has been illustrated herein as defaulting to the coupled position in the absence of hydraulic pressure, it should now be understood that latching arrangement 36 may alternatively be configured to default to the decoupled position in the absence of hydraulic pressure. This may be accomplished, for example, by reversing the direction which lock pin spring 44 acts upon lock pin 42. Furthermore, while latching arrangement 36 has been illustrated as being actuated based upon hydraulic pressure, other forms of actuation are anticipated, for example, by including a solenoid actuator which affects the position of lock pin 42 based on application of an electric current to the solenoid actuator. Also furthermore, while lock pin 46 has been described herein as being located within outer arm 14, it should be understood that lock pin 46 may alternatively be located within inner arm 12 and selectively engage a stop surface of outer arm 14.

Inner arm 12, outer arm 14, and related features thereof will now be described in greater detail which limit the travel of inner arm 12 relative to outer arm 14 in the second direction, i.e. clockwise as shown in FIGS. 3 and 4. The extent to which inner arm 12 pivots relative to outer arm 14 in the second direction is determined by the rotational position of a travel stop 54 which is supported by one of inner arm 12 and outer arm 14. As illustrated in FIGS. 1-4, and as will first be described, travel stop 54 may be supported by outer arm 14. In order for outer arm 14 to support travel stop 54, outer arm 14 is provided with a pair of opposing mounting bosses 56 which project from an outer arm body 58 which joints walls 28 and within which socket 32 and lock pin bore 38 are formed. Mounting bosses 56 project from outer arm body 58 such that mounting bosses 56 overhang central opening 16. Each mounting boss 56 includes a respective mounting boss aperture 62 extending therethrough such that mounting boss aperture 62 of each mounting boss 56 is centered about, and extends along, a travel stop axis 54*a* such that mounting bosses 56 are spaced apart from each other along travel stop axis 54*a*. Preferably, mounting boss apertures 62 are cylindrical in shape. Also preferably, mounting bosses 56 are integrally formed together with outer arm 14 as a single piece of material.

Figure 5:
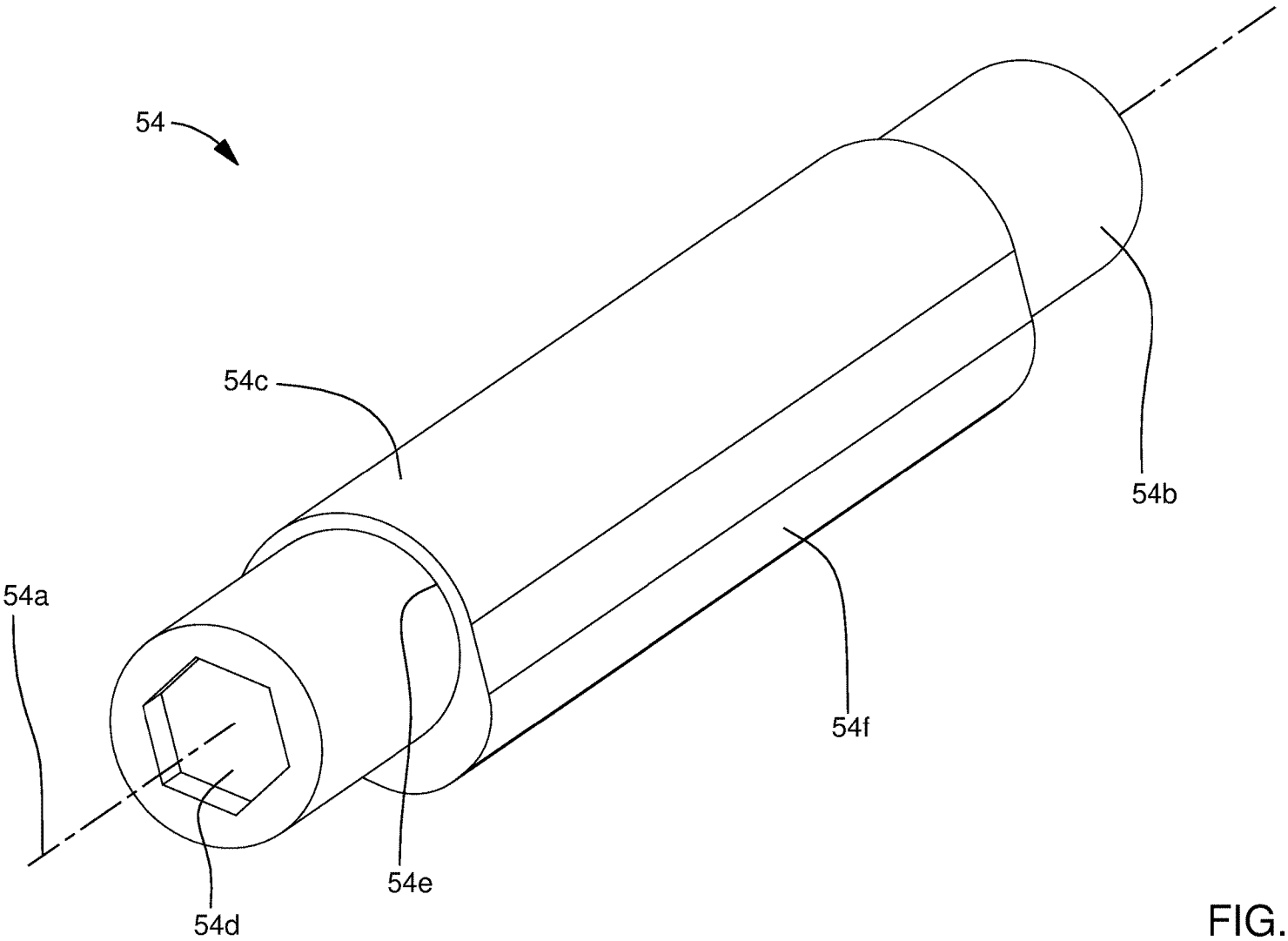
FIG. 5 is an isometric view of a travel stop of the rocker arm of FIG. 1.

Travel stop 54 will now be described in greater detail with additional reference to FIG. 5. Travel stop 54 may be a two-piece component, best shown in FIG. 2, which includes an inner travel stop element 54*b* and an outer travel stop element 54*c*. Inner travel stop element 54*b* may be a cylinder as shown which is sized to be complementary to mounting boss apertures 62 such that inner travel stop element 54*b* is either a close-sliding fit or a light interference fit with mounting boss apertures 62, but may alternatively have other external shapes that provide such a fit within inner travel stop element 54*b* and mounting boss apertures 62, for example, hex-shape, star-shape, and the like. In either case, i.e. close-sliding fit or light interference fit, inner travel stop element 54*b* is sized to prevent radial movement within mounting boss apertures 62 while allowing travel stop 54 to be rotated to the extent to which inner arm 12 is able to pivot relative to outer arm 14 in the second direction. At least one axial end of inner travel stop element 54*b* may include a drive feature 54*d* which is configured to receive a tool (not show) in order to apply rotational movement to travel stop 54 about travel stop axis 54*a* during manufacturing. As shown, drive feature 54*d* may be an internal hex extending into the axial end of inner travel stop element 54*b*, but may alternatively take any number of known drive features typically used to receive a tool for inducing rotational movement on a member. Such alternative drive features may include, but are not limited to, an external hex, internal or external hexalobular configurations, i.e. Torx®, screwdriver slot, and the like. Outer travel stop element 54*c* includes an outer travel stop bore 54*e* extending therethrough such that outer travel stop bore 54*e* is centered about, and extends along, travel stop axis 54*a*. Outer travel stop bore 54*e* and inner travel stop element 54*b* are sized to provide an interference fit which prevents relative rotation between inner travel stop element 54*b* and outer travel stop element 54*c*. While outer travel stop bore 54*e* has been illustrated herein as cylindrical, it should be understood that outer travel stop bore 54*e* can be any shape, for example hex-shape, star-shape, or cylindrical with splines. Outer travel stop element 54*c* extends axially along travel stop axis 54*a* such that outer travel stop element 54*c* is received axially between mounting bosses 56. Outer travel stop element 54*c* also includes a travel stop surface 54*f* which is eccentric to travel stop axis 54*a*, i.e. travel stop surface 54*f* is not a constant distance radially outward from travel stop axis 54*a* when sectioned by a plane that is perpendicular to travel stop axis 54*a*, and such that travel stop surface 54*f* surrounds travel stop axis 54*a*.

A complementary stop surface 55 is provided which engages travel stop surface 54*f* in order to limit the extent to which inner arm 12 pivots relative to outer arm 14 in the second direction. Since travel stop 54 is supported by outer arm 14, in this embodiment, complementary stop surface 55 is supported by inner arm 12, and may be provided directly on inner arm 12 as shown. As shown in FIG. 3, complementary stop surface 55 may be located within central opening 16 and may be located between travel stop surface 54*f* and lock pin 42 when lock pin 42 is in the coupled state.

Figure 6:
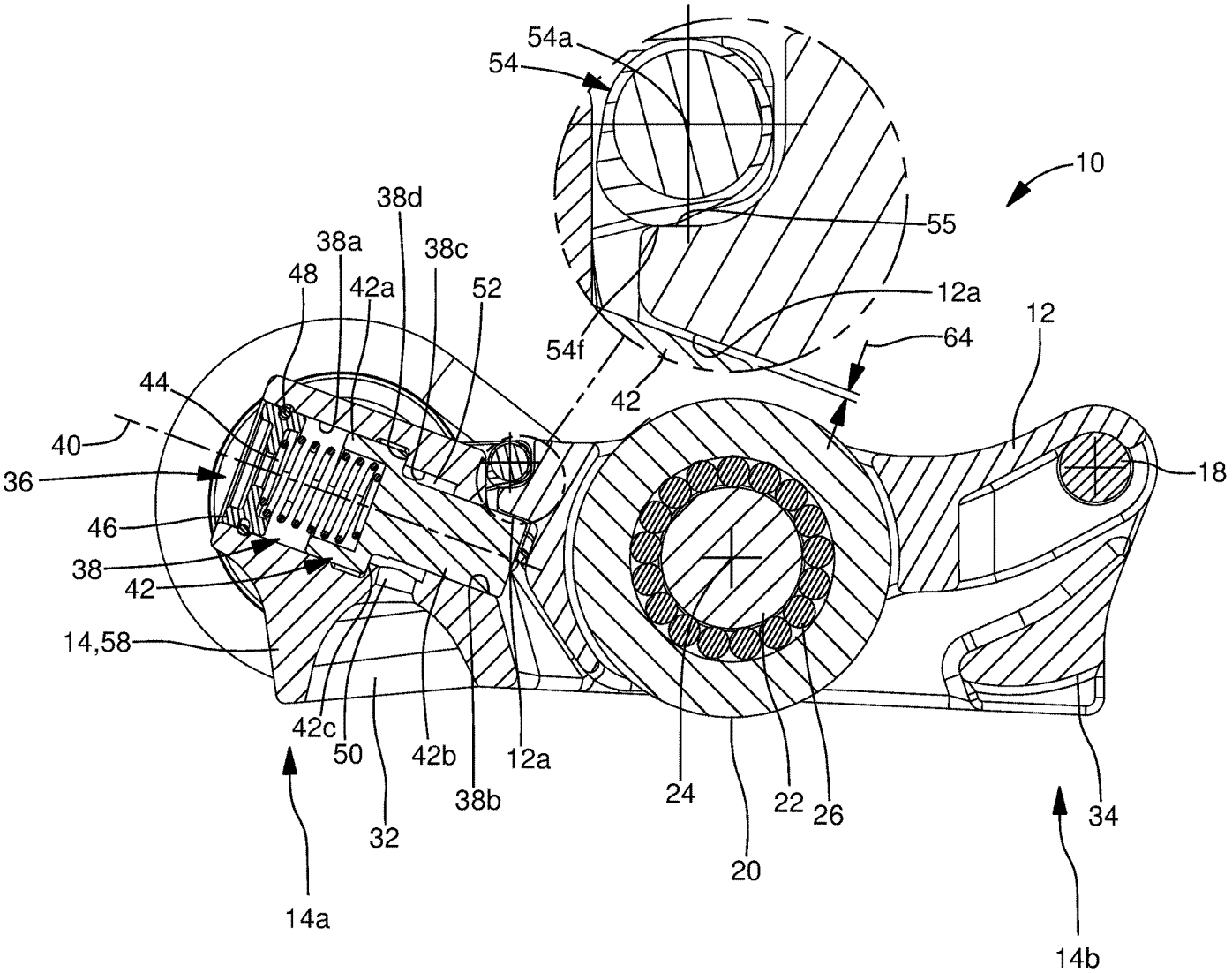
FIG. 6 is the cross-section view of FIG. 3, now shown with the travel stop rotated to a different rotational position.

In order to assemble to travel stop 54 to outer arm 14, outer travel stop element 54*c* may first be positioned axially between mounting bosses 56 prior to being mated with inner travel stop element 54*b*. Next, inner travel stop element 54*b* is inserted through one of mounting boss apertures 62 and inserted into outer travel stop bore 54*e* until each end of inner travel stop element 54*b* is located within respective mounting boss apertures 62. Inner travel stop element 54*b* is fixed within outer travel stop bore 54*e*, for example, by interference fit or welding. Travel stop 54 is then rotated, using drive feature 54*d*, in order to vary the stop position of inner arm 12 relative to outer arm 14 in the second direction, i.e. clockwise as shown in FIG. 3. Travel stop 54 is rotated until a desired amount of lash, i.e. distance, between lock pin 42 and an inner arm stop surface 12*a* of inner arm 12 is achieved where the lash is the distance between lock pin 42 and inner arm stop surface 12*a* when travel stop 54 is engaged with complementary stop surface 55 of inner arm 12. In this way, the extent to which inner arm 12 pivots relative to outer arm 14 in the second direction is dependent upon the rotational position of travel stop 54 about travel stop axis 54*a*. After the desired lash has been set, travel stop 54 is fixed to outer arm 14 in order to prevent rotation of travel stop 54 about travel stop axis 54*a*, thereby preventing a change in the amount of lash between lock pin 42 and inner arm 12. Travel stop 54 may be fixed to outer arm 14, by way of non-limiting example only, through welding or staking. In order to illustrate how rotation of travel stop 54 about travel stop axis 54*a* alters the lash between lock pin 42 and inner arm stop surface 12*a*, FIG. 6 has been provided which is similar to FIG. 3, except that FIG. 6 shows travel stop 54 being rotated about travel stop axis 54*a* compared to FIG. 3 which allows inner arm 12 to pivot farther in the second position, i.e. clockwise, compared to FIG. 3, thereby increasing lash as indicated by reference number 64 in the enlarge circle of FIG. 6.

Figure 7:
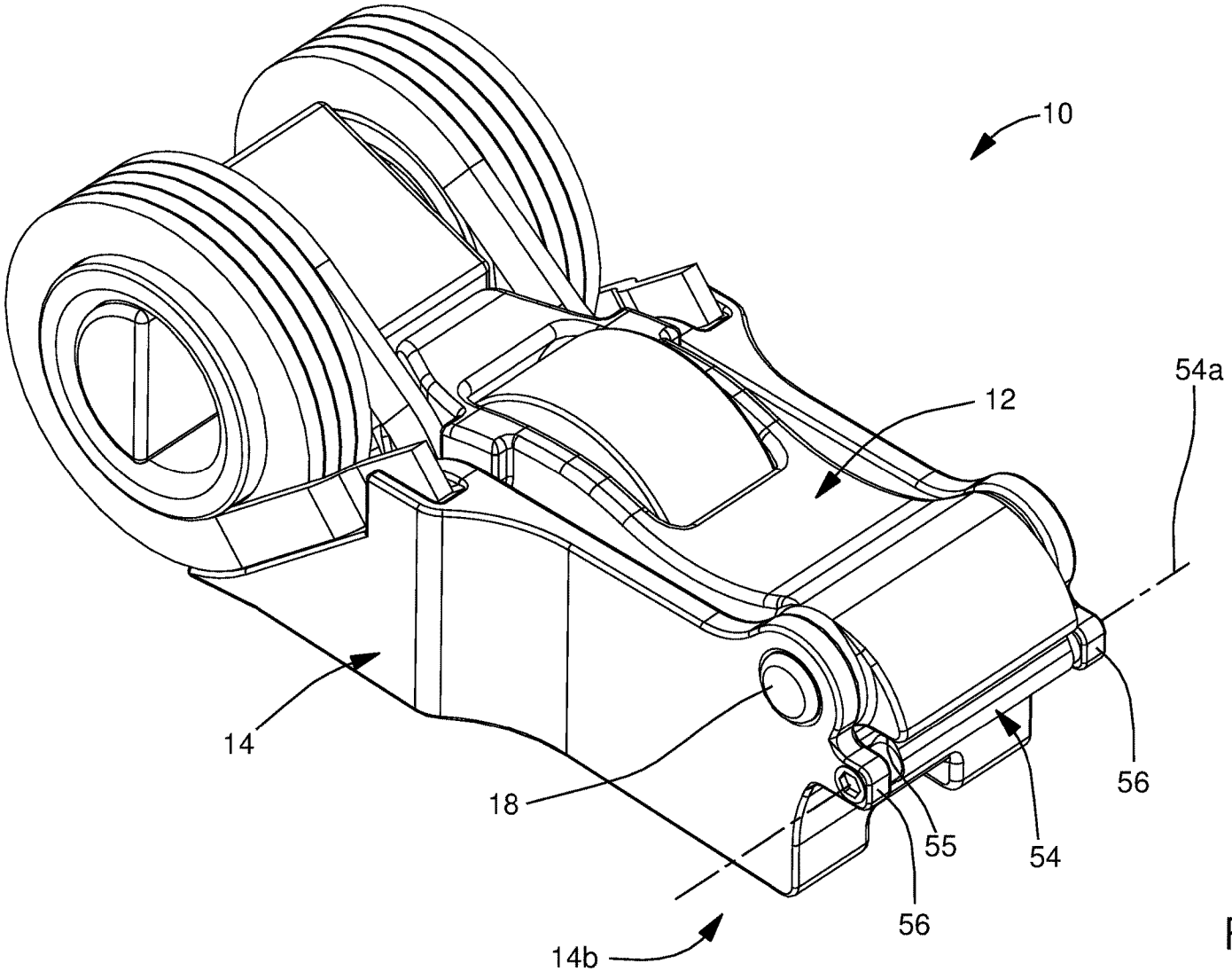
FIGS. 7-9 are isometric views of the rocker arm of FIG. 1 showing the travel stop mounted in different locations.

Now with reference to FIG. 7, rocker arm 10 is shown with an alternative location for mounting bosses 56 where only the reference numbers necessary to understand the differences of FIG. 7 compared to FIGS. 1-4 have been included. More specifically, in FIG. 7, mounting bosses 56 are moved to the distal end of outer arm 14 which is proximal to second end 14*b*. Due to the change in location of mounting bosses 56, and resulting change in location of travel stop 54, complementary stop surface 55 of inner arm 12 is also relocated, and is now positioned at the distal end of inner arm 12 which is proximal to second end 14*b*. This location places mounting bosses 56 is closer proximity to pivot shaft 18, and as a result, rotation of travel stop 54 about travel stop axis 54*a* provides in a greater magnitude of lash adjustment that is possible. Consequently, rocker arm 10 as shown in FIG. 7 may be desirable when greater amounts of lash may need to be accommodated.

Figure 8:
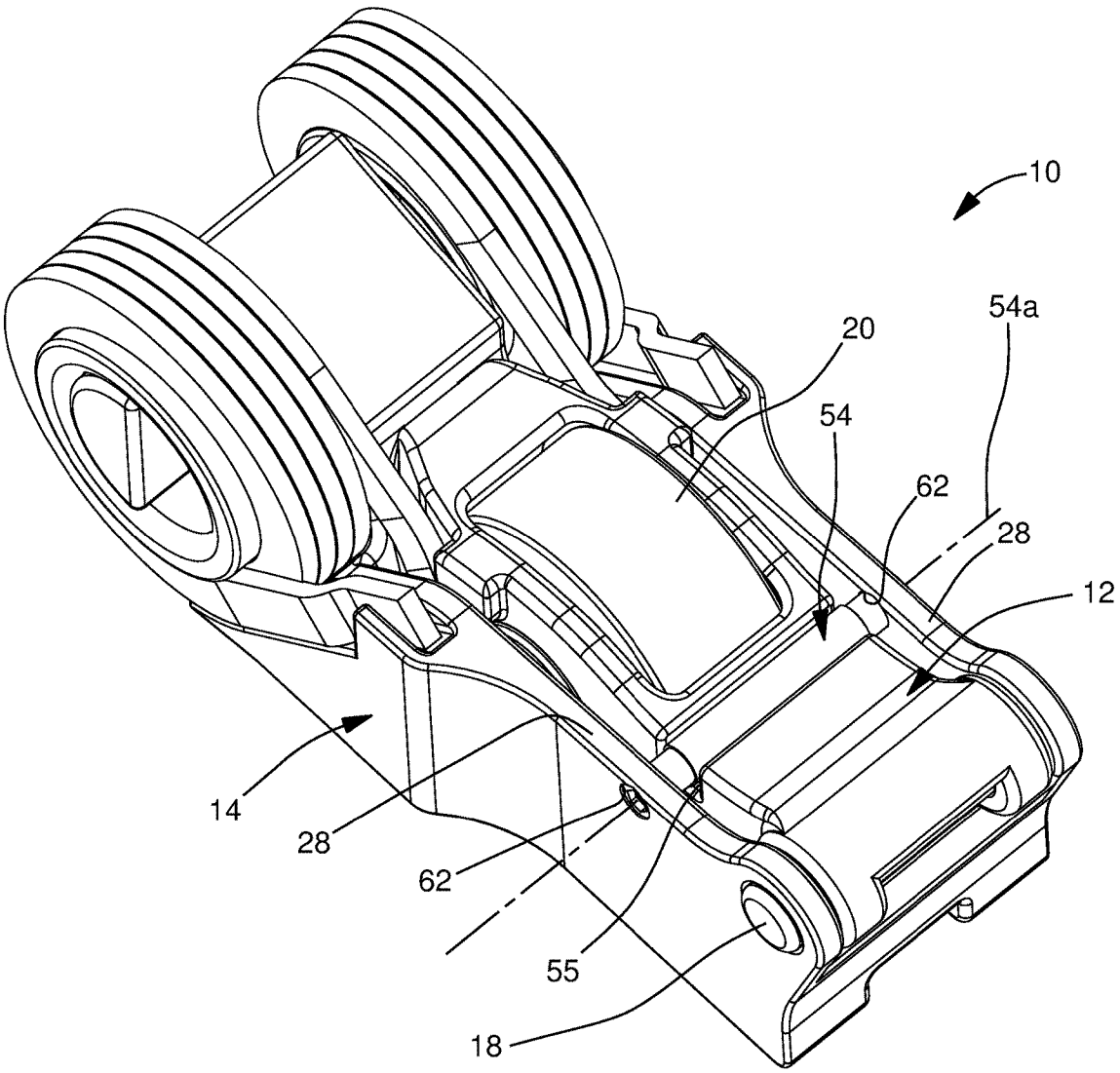

Now with reference to FIG. 8, rocker arm 10 is shown where only the reference numbers necessary to understand the differences of FIG. 8 compared to FIGS. 1-4 have been included. More specifically, mounting bosses 56 have been omitted and mounting boss apertures 62 have been provided directly in walls 28 of outer arm 14 such that travel stop 54 is located between pivot shaft 18 and roller 20. As a result of this location of travel stop 54, complementary stop surface 55 is now located at a location on inner arm 12 that is between pivot shaft 18 and roller 20. As shown in FIG. 8, complementary stop surface 55 may be located in a channel that laterally traverses inner arm 12.

Figure 9:
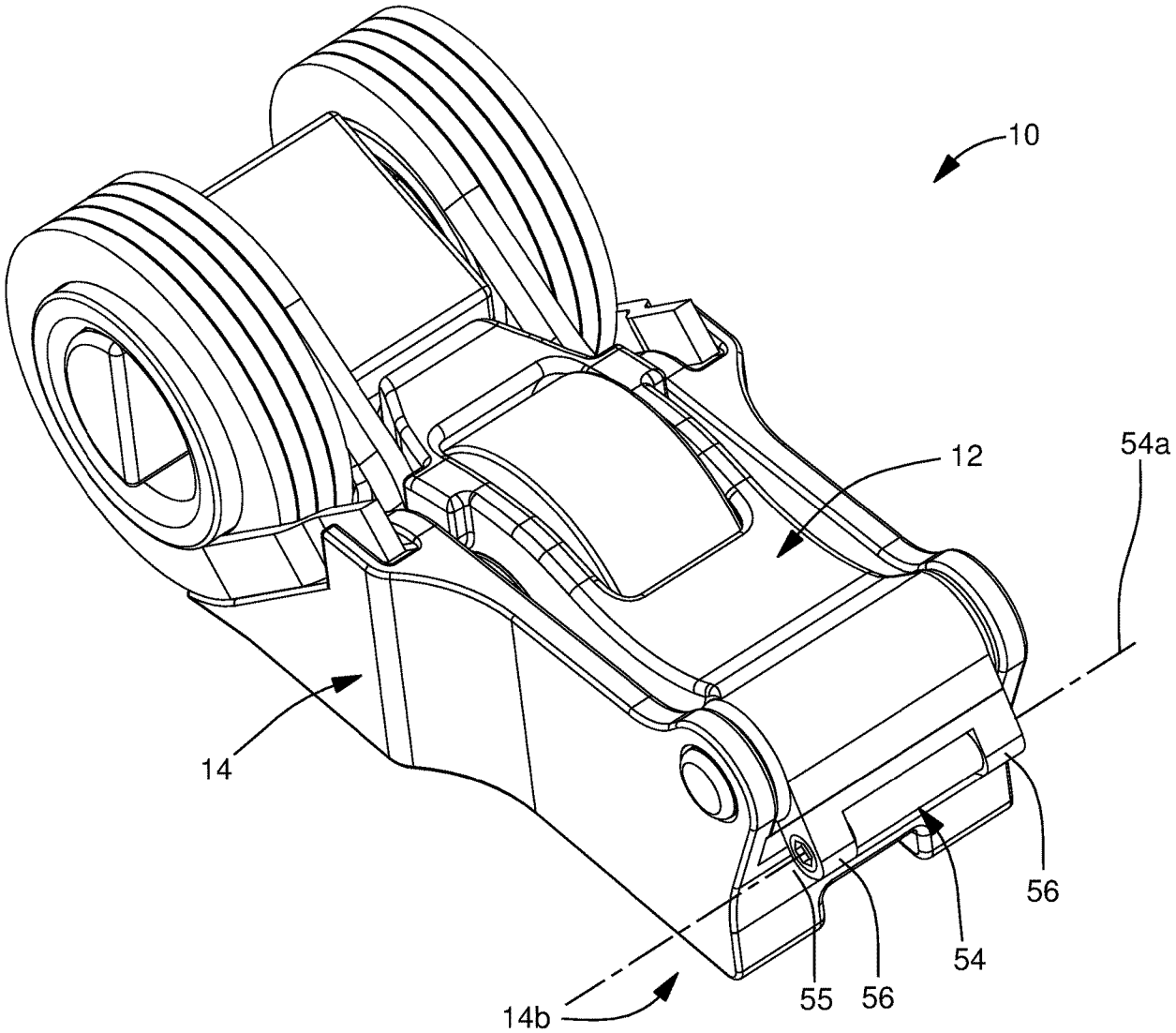

Now with reference to FIG. 9, rocker arm 10 is shown where travel stop 54 is supported by inner arm 12 rather than by outer arm 14 and where only the reference numbers necessary to understand the differences of FIG. 9 compared to FIGS. 1-4 have been included. Since travel stop 54 is now supported by inner arm 12, mounting bosses 56 are included on inner arm 12, and complementary stop surface 55 is moved to be supported by outer arm 14. Also as shown, mounting bosses 56 may project from the distal end of inner arm 12 that is proximal to second end 14*b*, and similarly, complementary stop surface 55 is located at the distal end of outer arm 14 that is proximal to second end 14*b*.

In the alternative arrangements shown in FIGS. 7-9, as well as the arrangement of FIGS. 1-6, it should be understand that the fundamental principle of travel stop 54 is the same. More specifically, travel stop 54 limits the extent to which inner arm 12 is able to pivot relative to outer arm 14 in the second direction, and furthermore, the extent to which inner arm 12 is able to pivot relative to outer arm 14 is dependent upon the rotational position of travel stop 54 about travel stop axis 54*a*.

While travel stop 54 has been illustrated herein as being supported at both axial ends, it should be understood that travel stop 54 may alternatively be supported only at one axial end. In other words, only one mounting boss 56 may be provided and travel stop 54 is cantilevered from the single mounting boss 56. In this arrangement, it is envisioned that the length of travel stop 54 may be significantly reduced. This arrangement would permit travel stop 54 to be made as a single piece, rather than in multiple pieces, i.e. inner travel stop element 54*b* and outer travel stop element 54*c*. Consequently, manufacturing and assembly may be simplified, thereby resulting in reduced manufacturing costs.

Rocker arm 10 as described herein allows the lash between lock pin 42 and the inner arm 12 to be easily and economically set and also limits the extent to which inner arm 12 is able to pivot relative to outer arm 14.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm;

an inner arm having an inner follower configured to follow said camshaft, wherein said outer arm and said inner arm selectively pivot relative to each other;

a lock pin which moves between 1) a coupled position in which said lock pin prevents said inner arm from pivoting relative to said outer arm past a predetermined position of said inner arm relative to said outer arm in a first direction and 2) a decoupled position in which said lock pin permits said inner arm to pivot relative to said outer arm past said predetermined position in said first direction;

a lost motion spring which biases said inner arm to pivot relative to said outer arm in a second direction which is opposite of said first direction; and a travel stop extending along a travel stop axis and having a travel stop surface which surrounds said travel stop axis such that said travel stop surface is eccentric to said travel stop axis, said travel stop being supported by one of said inner arm and said outer arm such that a remaining one of said inner arm and said outer arm which is opposite of said one of said inner arm and said outer arm which supports said travel stop supports a complementary stop surface which engages said travel stop surface thereby limiting an extent to which said inner arm pivots relative to said outer arm in said second direction;

wherein the extent to which said inner arm pivots relative to said outer arm in said second direction is dependent upon a rotational position of said travel stop about said travel stop axis.

2. A rocker arm as in claim 1, wherein said one of said inner arm and said outer arm which supports said travel stop includes an aperture within which a portion of said travel stop is located.

3. A rocker arm as in claim 2, wherein said aperture is cylindrical and is centered about said travel stop axis.

4. A rocker arm as in claim 2, wherein said aperture is a first aperture and wherein said one of said inner arm and said outer arm which supports said travel stop includes a second aperture within which another portion of said travel stop is located.

5. A rocker arm as in claim 4, wherein said first aperture and said second aperture are each centered about said travel stop axis.

6. A rocker arm as in claim 4, wherein said first aperture and said second aperture are spaced apart from each other along said travel stop axis such that said travel stop surface is located between said first aperture and said second aperture.

7. A rocker arm as in claim 4, wherein said travel stop comprises:

an outer travel stop element which includes an outer travel stop bore which extends along, and is centered about, said travel stop axis;

an inner travel stop element which extends through said outer travel stop bore and into said first aperture and said second aperture.

8. A rocker arm as in claim 7, wherein said outer travel stop element includes said travel stop surface.

9. A rocker arm as in claim 7, wherein said inner travel stop element is a cylinder which mates with said outer travel stop bore in an interference fit which prevents relative rotation between said outer travel stop element and said inner travel stop element.

10. A rocker arm as in claim 7, wherein said inner travel stop element includes a drive feature configured to receive a tool used to impart torque on said travel stop about said travel stop axis.

11. A rocker arm as in claim 10, wherein said drive feature is located at an axial end of said inner travel stop element.

12. A rocker arm as in claim 4, wherein said one of said inner arm and said outer arm which supports said travel stop includes a first mounting boss through which said first aperture extends and also includes a second mounting boss through which said second aperture extends, said first mounting boss and said second mounting boss projecting from said one of said inner arm and said outer arm which supports said travel stop.

13. A rocker arm as in claim 12, wherein said first mounting boss and said second mounting boss project from said outer arm and overhang a central opening defined by said outer arm within which said inner arm is located.

14. A rocker arm as in claim 1, wherein said inner arm pivots relative to said outer arm about a pivot shaft and wherein said inner follower is located between said pivot shaft and said travel stop.

15. A rocker arm as in claim 1, wherein said inner arm pivots relative to said outer arm about a pivot shaft and wherein said pivot shaft is located between said inner follower and said travel stop.

16. A rocker arm as in claim 1, wherein said inner arm pivots relative to said outer arm about a pivot shaft and wherein said travel stop is located between said inner follower and said pivot shaft.

17. A method for manufacturing a rocker arm of claim 1, said method comprising:

rotating said travel stop about said travel stop axis thereby altering lash between said lock pin and said inner arm; and fixing said travel stop, after a target lash is achieved by said step of rotating said travel stop, thereby preventing rotation of said travel stop about said travel stop axis.

* * * * *